US005304257A

United States Patent [19]

Pearlstein et al.

[11] Patent Number: 5,304,257

[45] Date of Patent: Apr. 19, 1994

[54] TRIVALENT CHROMIUM CONVERSION COATINGS FOR ALUMINUM

[75] Inventors: Fred Pearlstein, Philadelphia; Vinod S. Agarawala, Warminster, both of Pa.

[73] Assignee: The United States of America as represented by the Secretary of the Navy, Washington, D.C.

[21] Appl. No.: 126,869

[22] Filed: Sep. 27, 1993

[51] Int. Cl.[5] ..... C23C 22/56

[52] U.S. Cl. ..... 148/265; 148/267

[58] Field of Search ..... 148/265, 267, 276, 275

[56] References Cited

U.S. PATENT DOCUMENTS 4,171,231 10/1979 Bishop ..... 148/267

FOREIGN PATENT DOCUMENTS 0031114 3/1980 Japan ..... 148/267

*Primary Examiner*—Sam Silverstein

*Attorney, Agent, or Firm*—James V. Tura; James B. Bechtel; Susan E. Verona

[57] ABSTRACT

Corrosion resistant coatings are formed on aluminum by immersion in aqueous solutions containing chromic salts, a fluoride ion from compounds such as a fluosilicate with an alkali added near or slightly beyond the precipitation of the insoluble basic compounds. Trivalent chromium films formed on the aluminum surface when tested in 5% NaCl salt spray chamber showed corrosion resistance in excess of 96 hours. After a post-treatment with peroxide or permanganate solutions, the corrosion resistance for the aluminum substrates exceeded 168 hours. Trivalent chromium coated aluminum serves as an effective base for paint primers. Anodized aluminums were also afforded excellent corrosion resistance, after being treated in dilute/basic chromic sulfate solutions and post-treated with peroxide.

8 Claims, No Drawings

TRIVALENT CHROMIUM CONVERSION COATINGS FOR ALUMINUM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to a method of treating metal surfaces to enhance corrosion resistant and paint bonding characteristics and more particularly, relates to trivalent chromium coatings for aluminum and aluminum alloys and, sealers for anodized aluminum substrates.

It is generally known to treat the surfaces of metals, such as zinc, cadmium, or aluminum with aqueous chromate (hexavalent chromium) solutions which contain chemicals that dissolve the surface of the metal and form insoluble films known as "chromate conversion coatings." These chromium coatings, are corrosion resistant and protect the metal from various elements which cause corrosion. In addition, it is known that chromate conversion coatings generally have good paint bonding characteristics and, therefore, provide an excellent base for paint or other finishes.

Although the aforementioned coatings enhance corrosion resistant and paint bonding properties, the coatings have a serious drawback, i.e., the toxic nature of the hexavalent chromium constituent. This is a serious problem from two viewpoints, one being the handling of the solution by operators and the other, the disposal of the used solution. The disposal problem, however, can be mitigated by reducing the hexavalent chromium to the comparatively innocuous trivalent form before disposal. This method is expensive and therefore can be a major cost factor in the overall metal treating process. Therefore, it is highly desirable to have coatings which are substantially free of hexavalent chromium, but at the same time capable of imparting corrosion resistant and paint bonding properties which are comparable to those imparted by conventional chromium coatings.

Of particular interest is the use of chromate conversion coatings on aircraft aluminum alloys due to the excellent corrosion resistance and the ability to serve as an effective base for paint. The baths used to develop these coatings contain chromates, i.e., hexavalent chromium, and it is the residual chromates in the coating that is largely responsible for the high degree of corrosion inhibition. However, these same chromates are highly toxic and their presence in waste water effluents is severely restricted. It would therefore, be desirable to provide a coating for aluminum and its alloys and for sealing of anodized aluminum utilizing relatively nontoxic chemicals that could serve as an alternative to the toxic hexavalent chromate coatings.

In the prior art, trivalent chromium baths (U.S. Pat. No. 4,171,231) have been used to produce coatings on zinc and zinc plate to provide a decorative "clear to light blue finish" which are characterized as having superior corrosion resistance. These baths contain "trivalent" chromium as substantially the only chromium ion, with a fluoride ion, an acid other than nitric acid and an oxidizing agent. The operating range of the baths is at a pH between about 2 to 4 and preferably between 1 to 3. The baths are used to achieve a single-dip chromate finish on all types of zinc plate. The implication is that the presence of the oxidizer, in situ, produces hexavalent chromium on the zinc surface without any oxidation or conversion of the trivalent chromium in the bath to the hexavalent form. Patentee discloses that without the oxidizing agent in the bath, corrosion resistance was poor, i.e., extensive corrosion after 24 hours with a 5% salt spray exposure, whereas with the oxidizing agent in the bath there was 0–10% of white corrosion and some panels were free of white salt after 50 hours of salt spray exposure.

This invention, in comparison, utilizes trivalent chromium as the only chromium ion in the bath with a fluoride ion, preferably from a complex compound such as a fluosilicate at a specific pH range. It was found that the addition of an oxidizing agent such as peroxide to the bath, in situ, slowly oxidized the trivalent chromium to the toxic hexavalent form. This conversion to the hexavalent form is contrary to the method used by this invention; namely, utilization of a bath composition completely free of hexavalent chromium.

SUMMARY OF THE INVENTION

This invention relates to a process for preparing a corrosion-resistant trivalent chromium coating on aluminum, aluminum alloy and for sealing of anodized aluminum substrates which comprises treating said substrates with an acidic aqueous solution containing from about 0.2 to 3.0 g/l of trivalent chromium as a water soluble compound, about 0.05 to 1.5 g/l fluoride as a water soluble fluoride compound and a sufficient amount of an alkaline reagent to maintain the aqueous solution at a pH ranging from about 4.0 to 5.5 sufficient to convert the trivalent chromium compounds to more basic soluble trivalent compounds thereby forming a trivalent-chromium coating on said substrates. However, alkali should not be added beyond the point where a persistent cloudiness (precipitation) forms in the bath. Fluoride is not required when used solely for sealing anodized aluminum. The trivalent-chromium coatings formed on the aluminum substrates including sealing the anodized aluminum in accordance with this invention may be further improved by subsequently post-treating the trivalent chromium coating with effective amounts of an oxidizing agent, e.g., solution of peroxide, whereby only less than about 2.0 percent by weight of the trivalent coating is converted to the hexavalent form on the aluminum substrate.

It is therefore an object of this invention to provide a novel chromium-containing solution for treating aluminum, including anodized aluminum which contains no hexavalent chromium.

It is another object of this invention to provide a composition for treating aluminum which contains only trivalent chromium.

It is still another object of this invention to provide a trivalent chromium-containing solution wherein said chromium has little or no tendency to precipitate from the solution.

It is a further object of this invention to provide a method of preparing trivalent chromium chemical-conversion coatings on aluminum and a seal on anodized aluminum surfaces.

It is a further object of this invention to provide a method of sealing anodized aluminum to obtain improved corrosion resistance.

These and other objects will become apparent to those skilled in the art from the description of the invention as follows.

DETAILED DESCRIPTION OF THE PREFERRED EMBODIMENT

In producing a corrosion-resistant coating on an aluminum surface, the surface is first cleaned of soils and oxides which can interfere with the coating process. The surface can be cleaned by any convenient method known to the art. A suitable cleaning process uses an alkaline cleaner. Subsequent to the cleaning, a water rinse is employed and a deoxidizer may be used to remove any oxides that may be present on the metal surfaces. Continuous overflowing water rinses, for example, are suitable to remove any residual materials from the surface. It is only necessary that the surface be clean of all organic and inorganic residue. Subsequent to the cleaning and rinsing, the aluminum surface is treated with the trivalent chromium coating solution of this invention.

Various methods of contacting the aluminum surface with the coating solution commonly employed in the metal coating art is acceptable. For example, the aluminum surfaces or substrates can be treated or contacted by spraying, dipping, roller coating, or the like. The chromium coating or sealer can be formed on the aluminum surface at temperatures ranging from about 16° C. and about 90° C. Although the coating solution or bath can be employed at temperatures in excess of 50° C., it is preferred that the coating operation be performed at or slightly above room temperature, i.e., between about 20° C. and 42° C.

More specifically, the process of this invention requires a certain amount of alkali (usually sodium hydroxide) to be added to the bath to promote hydrolysis and conversion of the trivalent chromium compounds to more basic forms. The proper amount of alkali (usually as 0.5N to 6N NaOH solution) to be added to a bath is determined by dispensing the alkali to the bath with agitation, while maintaining a pH between 4 and 5.5 for about 5 to 30 minutes or until a precipitate persists in the bath. The preferred pH range is between 4.1 to 4.7 for about 5 to 10 minutes. The coating of this invention when applied to aluminum will usually require 96 to 168 hours exposure to salt spray before the first appearance of white salts corrosion. This is without any hexavalent chromium in the bath. The absence of $Cr^{+6}$ was determined by analysis of the bath by atomic absorption spectroscopy and the Hach Test Kit.

The process of this invention may include a post-treatment in a dilute oxidizer e.g., 10 ml/liter $H_2O_2$ (30%) to further improve the corrosion resistance of the trivalent chromium-containing coating to about 168 to 336 hours of salt spray exposure. The primary treatment bath of this invention is free of hexavalent chromium and since the post-treatment requires no rinse, there is no $Cr^{+6}$ in the waste stream. Occasionally, it may be necessary to discard the post-treatment bath, but the quantity of $Cr^{+6}$ contained in the bath is minuscule and will have virtually no environmental impact. Based on chemical analysis of a used post-treatment (peroxide) bath, the total hexavalent Cr content was found to be $<0.01$ p.p.m. This value is below the allowable limits for occasional discharge and therefore presents no difficulties. The coatings applied to aluminum in accordance with this invention are under 20 mg/ft$^2$ and when a peroxide post-treatment is used, the amount of $Cr^{+3}$ and $Cr^{+6}$ in the film are approximately 3.5 mg/ft$^2$ and 0.05 mg/ft$^2$, respectively.

Further, in accordance with this invention corrosion resistant films or sealers can be applied to bare or anodized aluminum alloys (2024-T3 and 7075-T6) by immersion in baths consisting essentially of chromic sulfate and fluosilicate. About 10 minute immersion time at 25° C. in the trivalent chromium bath was required to pass about 168 hours of salt spray corrosion resistance. However, immersion time can be reduced to as little as 2.5 minutes by mildly heating the bath i.e., temperature of about 42° C.

For comparison purposes, preliminary studies were conducted with molybdate solutions which produced thin colored films (presumably molybdic oxides) on immersed 7075-T6 Al-alloy. These coatings had only slight salt spray resistance. With additives, corrosion resistance of about 24 hours salt spray exposure was achieved. For example, improvement was obtained with 5 minute immersion at 25° C. in the following bath:

EXAMPLE I 6 g/l $Na_2MoO_4$
4 g/l $Na_2SiF_6$
5 g/l $Na_3PO_4.2H_2O$
2 g/l Benzotriazole In another study, 20 minute immersion of 7075-T6 Al alloy in 20 g/l $Na_2CO_3$ + 10 g/l $Na_2SO_4$ solution at 50° C. produced films of approximately 200 mg/ft$^2$ but with only a modicum of corrosion resistance. However, "sealing" these films in certain aqueous solutions improved the corrosion resistance. For example, up to 72 hours salt spray resistance was attained by immersion of the rinsed carbonate film for 5 minutes in 10 g/l $KMnO_4$ solution at 50° C.

The study was then directed towards the use of trivalent chromium films. It was found that insoluble trivalent chromium compounds could indeed be formed on aluminum. It was also found possible to subsequently oxidize or post-treat the film whereby less than about 2.0% by weight of the trivalent chromium was converted to the hexavalent chromium. The post-treatment comprises a dilute solution of peroxide, e.g., 0.2 to about 40% by volume of $H_2O_2$ (30%). Thus, it was found possible to attain corrosion resistant films or coatings comparable to other chromate coatings without the use of toxic hexavalent chromium. It is known that trivalent chromium is substantially less toxic than the hexavalent form.

More specifically, it was found that coating baths containing $Cr_2(SO_4)_3$ and $Na_2SiF_6$ when brought with NaOH to a pH, e.g., pH 4.0 to 5.5 near or slightly beyond precipitation of the basic compounds, were capable of forming light but visible films on Al-alloys which had significant corrosion resistance. When the pH was raised by addition of NaOH, the pH falls with time to considerably lower values. The reason being that trivalent chromium salts form coordination compounds of coordination number six. The hydrolysis of coordination complexes is accelerated by addition of alkali and forms successively in the following manner:

$$[Cr(H_2O)_6]Cl_3 \rightarrow [Cr(OH)(H_2O)_5]Cl_2 + HCl$$

$$(Cr(OH)(H_2O)_5]C12 \rightarrow [Cr(OH)_2(H_2O)_4]Cl + HCl$$

$$[Cr(OH)_2(H_2O)4]Cl \rightarrow [Cr(OH)_3(H_2O)_3] + HCl$$

Analogous compounds are formed with the sulfate. The liberation of free acid accounts for the observed decrease in pH with time after alkali has been added to the chromium sulfate, $Cr_2(SO_4)_3$, solution. The molecular weights of the compound may be increased by "olation" which is favored by heat and basicity as shown below:

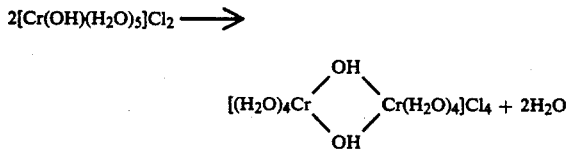

Olation tends to promote hydrolysis by shifting the hydrolysis equilibrium. For example, a 12 liter bath was prepared with deionized water to which was added 4 g/l $Cr_4(SO_4)_5(OH)_2$ [Fluka Co.; 26% $Cr_2O_3$ and 23-24% $Na_2SO_4$] and 0.4 g/l $Na_2SiF_6$ with continuous stirring for about one hour to dissolve the chemicals. Then 20 ml/l of 0.5N NaOH was added slowly with stirring. The bath was permitted to stand one week before use. Bath pH was over 5 when first prepared but after one week, the pH had decreased to about 3.7 and the bath was somewhat cloudy indicating precipitation of chromic hydroxide (hydrous chromic oxide). The bath was analyzed by atomic absorption analysis and found to contain 597 p.p.m. Cr which is about 84% of theoretical.

Aluminum alloys (7075-T6 and 2024-T3) panels, 3"×5"×0.030", were held on titanium racks and treated as follows:

a) Immersed 30 minutes in proprietary alkaline cleaner [53 g/l Turco 4215-NC-LT] at 55° C. with air agitation and followed by room temperature running water rinses;

b) Immersed 15 minutes in proprietary nonchromate deoxidizer [180 g/l Turco Smut-Go] at 25° C. and followed by room temperature running water rinses;

c) Immersed in 12 liter trivalent chromium bath as described above at 25° C. without agitation for 5,10, 20 or 40 minutes and given one of the following post treatments:

(1) None (2) 30 seconds in 10 ml/l $H_2O_2$ (30%) in deionized water at 25° C.; drain dried without rinsing.

(3) 30 seconds in 5 g/l $KMnO_4$ at 25° C.; water rinsed and drain dried.

A scribe mark was made on each panel to ascertain whether there was any tendency for self-healing as is achieved with chromate conversion coatings. The panels were exposed to 5% neutral salt spray, in accordance with ASTM B-117 Standard Method. Visible films were produced on aluminum panels immersed 10 or more minutes in the trivalent chromium bath; pale tan at 10 minutes, pale violet at 20 minutes and pale blue at 40 minutes. The panels post-treated in permanganate were somewhat darker colored.

Film formation ma initiate with attack (oxidation) of the aluminum surface by fluoride-containing ions. The pH of the interfacial solution is increased leading to intimate precipitation of insoluble hydrous chromic oxides on the surface. However, electrochemical studies indicate that the mechanism is more complex. The film weight of panels, immersed 10 minutes in the trivalent chromium bath, was determined by stripping the film for 30 minutes in solution containing 35 ml/l $H_3PO_4$ (85%) +20 g/l $CrO_3$ at the boiling point, rinsing, drying and reweighing. The loss of weight averaged 3.8 mg per panel or 18 mg/ft$^2$.

The results of salt spray exposures of panels treated various times in trivalent chromium bath are shown in Table I. After 336 hours exposure, the 7075-T6 panels that had been immersed 10, 20 or 40 minutes in trivalent chromium bath and provided with a permanganate post-treatment were free of corrosion or had only faint traces of corrosion. All 7075-T6 panels provided with the peroxide post-treatment were only slightly corroded. Panels immersed in trivalent chromium bath for 5 or 10 minutes without any post-treatment had only slight corrosion while those immersed 20 or 40 minutes were somewhat more corroded. In general, best corrosion resistance was obtained when panels were immersed 10 minutes. There was little evidence of self-healing at the scribe mark made in the 7075-T6 panels.

TABLE I

Corrosion Ratings* of Panels Treated in Trivalent Chromium Bath after 336 Hours Salt Spray Exposure.

| Immersion Time, Minute | Post-Treatment: None | 30 s, 10 ml/l $H_2O_2$ (30%) | 30 s, 5 g/l $KMnO_4$ Water Rinsed |
|---|---|---|---|
| | | Al 7075-T6 Alloy | |
| 5 | 3 | 3+ | 3+ |
| 10 | 3 | 3+ | 5 |
| 20 | 2+ | 3 | 4+ |
| 40 | 2+ | 3 | 4+ |
| | | Al 2024-T3 Alloy | |
| 5 | 0+ | 3 | 2 |
| 10 | 1 | 3 | 5 |
| 20 | 1+ | 2+ | 5 |
| 40 | 1 | 2+ | 5 |

*Rating Key
5-No Corrosion
4-Traces of Corrosion (incipient)
3-Slight Corrosion (<1% area affected)
2-Moderate Corrosion (1-5% area affected)
1-Considerable Corrosion (5-25% area affected)
0-Extensive Corrosion (>25% area affected)

The 2024-T3 panels after 336 hours salt spray exposure were completely uncorroded when trivalent chromium treated for 10 minutes or more and subjected to the permanganate post-treatment. There was only slight corrosion on panels treated 5 or 10 minutes and subjected to the peroxide post-treatment. Somewhat more corrosion was seen on the panels treated 20 or 40 minutes in trivalent chromium. In general, as found for the 7075-T6 panels, the best corrosion resistance was obtained after 10 minutes treatment in trivalent chromium. With 2024-T3 panels that were not subjected to a post-treatment, corrosion resistance showed considerable amounts of white salts. However, even the poorest of these were not nearly as badly corroded as bare (untreated) panels which were 95% covered with heavy white salts. The 2024-T3 panels showed self-healing properties at the scribe areas when a post-treatment was applied to those trivalent chromium treated 10 minutes or more.

Self-healing is believed to be due to the hexavalent chromium introduced into the coating by the peroxide or permanganate post-treatment. A panel treated for 10 minutes in the trivalent chromium bath and post treated with peroxide was leached 30 minutes in 200 ml of boiling water. The water was found to contain 0.05 p.p.m. of hexavalent chromium. A control panel, not peroxide post treated, had no hexavalent chromium. Total chromium in the coating was determined by dissolving the films 5 minutes in 25% (vol.) HCl at 25° C. and analyzing for Cr by atomic absorption spectroscopy. The solution contained 3.36 p.p.m. Cr or 0.73 mg Cr removed per panel. This indicates that the films contain only about 19% [0.73/3.8×100] of the films contain Cr. Hydrous chromic oxide would not account for more than about 40% of the film. It is, therefore, considered likely that aluminum compounds comprise much of the film weight.

There was significant benefit in corrosion resistance to using permanganate post treatment over peroxide; however, the latter is simpler and less polluting and is preferred when optimum corrosion resistance is not required. The trivalent chromium bath treatment was even more effective for the protection of 6061-T4 aluminum than 7075-T6 or 2024-T3.

It is important to note that baths controlled by pH alone is not sufficient to ensure a good operating bath. However, the amount of alkali added is critical. Baths were prepared with 4 grams per liter of Fluka salt, $Cr_4(SO_4)_5(OH)_2$+0.4 g/l $Na_2SiF_6$and various amounts of alkali added to obtain optimum pH. The baths were allowed to stand 2 weeks, pH measured, panels immersed 5 minutes at 25° C. and subjected to a peroxide post-treatment. The results are as shown in Table II.

TABLE II

The data shows the effect of sodium hydroxide addition on the corrosion resistance of aluminum alloys treated in the trivalent chromium bath. All panels were post treated in peroxide.

| Volume, ml N/2 NaOH Added/ Liter | pH After Standing 2 Weeks | Corrosion Rating* After Salt Spray Exposure | | | | | |
|---|---|---|---|---|---|---|---|
| | | 7075-T6 | | | 2024-T3 | | |
| | | 96 h | 168 h | 336 h | 96 h | 168 h | 336 h |
| 0 | 3.36 | 0 | 0 | 0 | 0 | 0 | 0 |
| 4 | 3.51 | 0 | 0 | 0 | 0 | 0 | 0 |
| 8 | 3.61 | 0 | 0 | 0 | 0 | 0 | 0 |
| 12 | 3.64 | 5 | 3+ | 3 | 4 | 3 | 2 |
| 16 | 3.68 | 5 | 4 | 3+ | 4 | 3 | 2+ |
| 20 | 3.71 | 5 | 4 | 4 | 4 | 3 | 2+ |

*See Table I for Rating Key.

The data shows that there is a critical transition between 8 and 12 ml/l of 0.5N NaOH addition. Solutions with 8 ml/l or less NaOH addition were incapable of providing protection to aluminum while those with 12 ml/l or more provided effective protection. The difference in pH was minimal (3.61 vs. 3.64). It is important to note that there was no precipitation in the bath with 12 ml/l of 0.5N NaOH, slight precipitation with 16 ml/l and moderate precipitation with 20 ml/l. Results of salt spray exposure on the corrosion ratings are shown in the above table. There is some increase in corrosion resistance with increasing 0.5N NaOH addition from 12 to 20 ml/l though the bath with 12 ml/l added had the benefit of no loss of trivalent chromium through precipitation.

Additional panels were treated in the solutions containing 12, 16 or 20 ml/l of 0.5N NaOH for only 2.5 minutes at 25° C. The baths were then heated to 42° C. and the tests repeated. The results of salt spray exposure tests on these panels are shown in Table III. All panels were post-treated in peroxide solution.

TABLE III

The data shows the effects of non-heated and heated trivalent chromium bath temperature on corrosion resistance of treated aluminum.

| Volume, ml/l 0.5N NaOH added | Corrosion Rating* After 168 Hours Salt Spray Exposure | | | |
|---|---|---|---|---|
| | 2.5 min. at 25° C. | | 2.5 min. 42° C. | |
| | 7075-T6 | 2024-T3 | 7075-T6 | 2024-T3 |
| 12 | 0 | 0 | 3 | 2+ |
| 16 | 1 | 0 | 3+ | 3 |
| 20 | 2+ | 2 | 3+ | 3 |

*See Table I for Rating Key.

Panels immersed 2.5 minutes at 25° C. in the trivalent chromium baths were generally poor though the bath containing 20 ml/l 0.5N NaOH provided substantially greater corrosion resistance than baths containing lesser amounts. Increasing the bath temperature to 42° C. considerably improved the corrosion resistance of panels immersed 2.5 minutes. Immersion of panels for 2.5 minutes at 42° C. provided approximately the same corrosion resistance as panels immersed 5 minutes at 25° C. Thus, it has been demonstrated that increasing the trivalent chromium bath temperature can substantially reduce the required treatment time.

After the 12 liter bath was used to treat approximately 150 panels (2.6 $ft^2$ per liter processed) the bath was reduced in effectiveness for providing corrosion resistance. However, it was found that addition of 0.4 g/l of $Na_2SiF_6$ with a small amount of NaOH rejuvenated the bath to previous effectiveness.

Although basic chromium sulfate was used in the above tests, ordinary chromic sulfate $\{Cr_2(SO_4)_3\}$ is similarly effective. Trivalent chromium solutions other than sulfate have been studied briefly; chloride, nitrate or acetate was not as effective as sulfate. However, a simple solution of 2.5 g/l $CrF_3.9H_2O$ properly adjusted with alkali showed some promise.

Preliminary tests showed that corrosion resistant films can be applied to aluminum by a wiping-on procedure using absorbent material soaked with the trivalent chromium solution. Post-treatment was applied, after rinsing, by a fine spray of dilute peroxide solution to cover the surface which was then allowed to dry. These results indicate that the process can be used effectively for treating large surfaces for which an immersion process is impracticable.

Panels treated in the 12 liter trivalent chromium bath for 5 or 20 minutes, with or without peroxide post-treatment, were painted with epoxy primer (MILC-23377), aged one week, immersed in distilled water 24 hours at room temperature, dried, scribed and tape-tested in accordance with ASTM D3359. Bare panels failed the tape-test while all trivalent chromium treated panels, with or without post-treatment, passed the paint adhesion tests.

Sealing or treatment of Anodized Aluminum

Aluminum 2024-T3 alloy panels were anodized in 15% (weight) sulfuric acid solution for 30 minutes at 21° C. at 18 volts. A trivalent chromium bath was prepared containing 5 g/l $Cr_4(SO_4)_5(OH)_2$ [Fluka Co.; 26% $Cr_2O_3$ and 23–24% $Na_2SO_4$] plus about 20 ml/l 0.5N NaOH for use as a seal or treatment for anodized aluminum. The following seals were applied to the anodized aluminum:

a) Water Seal - 15 minutes in deionized water at boiling.

b) Dichromate Seal - 15 minutes in 5 g/l $Na_2Cr_2O_7.2H_2O$ at boiling.

c) Trivalent Chromium Seal

A - Two minutes in above bath at boiling; rinse; two minutes in 10 ml/l $H_2O_2$ (30%)

B - 15 minutes in above bath at boiling; rinse; two minutes in 10 ml/l $H_2O_2$ (30%).

The treated panels were exposed to salt spray for over 3000 hours. The water sealed panels had considerable corrosion while the trivalent chromium seals were totally uncorroded. Thus, the effectiveness of a trivalent chromium seal or coating is well demonstrated. Immersion of anodized aluminum in the trivalent chromium bath at room temperature provided corrosion resistance far superior to water sealed panels but not quite as resistant to those dichromate sealed. Moreover, deletion of the peroxide post-treatment did not seriously reduce the corrosion resistance of trivalent chromium sealed anodized aluminum. It was also found that trivalent chromium seal coatings applied to chromic acid anodized panels were even more effective than dichromate with regard to improving corrosion resistance.

In formulating the coatings or seal compositions of this invention, the chromium can be added conveniently to the water in any of its water soluble forms in which the valence of the chromium is plus 3. For example, the chromium may be incorporated in the form of $Cr_2(So_4)_3$, $(NH_4)Cr(SO_4)_2$ or $KCr(SO_4)_2$. Mixtures of such compounds can be utilized. The aluminum surface that is coated according to the present invention can be either pure aluminum or aluminum base alloys containing over 50% aluminum. The preferred trivalent chromium concentration is within the range of about 0.4 to 1.5 grams per liter by weight of the aqueous solution. It has been found that particularly good results are obtained economically when the chromium is present in this preferred range. With regard to the preferred fluoride addition to the bath, it is desirable that the amount of fluoride added range from about 0.1 to 0.6 grams per liter. The complex fluoride such as fluorosilicate and not the simple fluorides are particularly preferred. However, fluoride addition is not required for anodized aluminum.

The treatment or coating of the aluminum surface can be carried out at various temperatures. For example, temperatures within the range of room temperature to about 90° F. can be utilized. Room temperature treatment is preferred inasmuch as this eliminates the necessity for providing and operating heating equipment. The coating may be air dried or accomplished by any of the methods well-known in the art, for example, oven drying, forced air drying, exposure to infra-red lamps, etc.

Various paints or organic coatings can be used to paint the chromium treated aluminum as described in U.S. Pat. Nos. 2,231,407; 2,299,433; 2,479,409 and 2,675,334. Specific coatings for the chromate treated aluminums particularly include the epoxy resins available from a variety of commercial sources. For example, "Epon 820" is an epoxy resin having an average molecular weight of about 380. Epon 828 has a molecular weight of 350–400 and an epoxide equivalent of about 175–210. Epon 1001 is an epoxy resin having an average molecular weight of about 1000 and an epoxide equivalent weight of 500.

While various embodiments of the invention have been disclosed, the specific compositions and methods described herein are not intended to limit the scope of the invention.

The invention claimed:

1. A process for preparing a corrosion-resistant trivalent chromium coating on aluminum and aluminum-alloy substrates which comprises treating said substrates with an acidic aqueous solution free of hexavalent chromium and contains from about 0.2 to 3.0 grams per liter of a water soluble trivalent chromium compound, from about 0.05 to 1.5 grams per liter of a water soluble fluoride compound and a sufficient amount of an alkaline reagent to maintain the aqueous solution at a pH ranging from about 4.0 to 5.5 to form the trivalent-chromium coating on said aluminum substrates.

2. The process of claim 1 wherein the trivalent chromium coating on the substrate is post-treated with an effective amount of an oxidizing agent to convert less than about 2.0 percent of the trivalent chromium in the coating to hexavalent chromium.

3. The process of claim 1 wherein the trivalent chromium salt is chromium sulfate and the fluoride compound is an alkali metal fluosilicate.

4. The process of claim 2 wherein the oxidizing agent is a peroxide.

5. The process of claim 4 wherein the oxidizing agent is a 0.2 to 40 percent by volume aqueous solution of 30% hydrogen peroxide.

6. The process of claim 1 wherein the substrate is an aluminum alloy.

7. The process of claim 1 wherein the substrates are treated in the acidic aqueous solution at ambient temperatures.

8. The process of claim 1 wherein the alkaline reagent is an alkali metal hydroxide.

* * * * *